US005771492A

United States Patent [19]

Cozza

[11] Patent Number: 5,771,492

[45] Date of Patent: Jun. 30, 1998

[54] ELECTRONIC GOLF GLOVE TRAINING DEVICE

[76] Inventor: Frank C. Cozza, 2726 Shelter Island Dr., Ste. 319, San Diego, Calif. 92106

[21] Appl. No.: 788,330

[22] Filed: Jan. 27, 1997

Related U.S. Application Data

[63] Continuation of Ser. No. 505,569, Jul. 21, 1995, Pat. No. 5,655,223.

[51] Int. Cl.[6] ..... A41D 19/00; A63B 69/36

[52] U.S. Cl. ..... 2/161.2; 2/905; 434/252; 473/205

[58] Field of Search ..... 2/161.2, 161.1, 2/161.3, 161.4, 160, 161.6, 163, 905; 434/252, 242; 473/205

[56] References Cited

U.S. PATENT DOCUMENTS

| | | | |
|---|---|---|---|
| 4,488,726 | 12/1984 | Murray | 2/161.2 |
| 5,184,827 | 2/1993 | Suttle et al. | 473/205 |
| 5,232,225 | 8/1993 | Snyder | 2/161.3 X |
| 5,324,038 | 6/1994 | Sasser | 434/242 X |
| 5,509,809 | 4/1996 | Clay | 434/252 |

FOREIGN PATENT DOCUMENTS

| | | | |
|---|---|---|---|
| 5-285249 | 11/1993 | Japan | 2/160 |
| WO92 12768 | 8/1992 | WIPO | 434/252 X |

*Primary Examiner*—Peter Nerbun

*Attorney, Agent, or Firm*—John R. Duncan; Frank D. Gilliam

[57] ABSTRACT

A golf training glove for emitting distinctive physically perceivable signals in response to a failure of a golfer to maintain a correct grip about a golf club during a golf swing. The basic glove is similar to a conventional golf glove with a hand access opening and plural finger stalls. A sensor is located in a region corresponding to the back of a golfer's thumb and/or in a region corresponding to an area around the intersection of the palm, and the middle, ring and little fingers. A physically perceivable signal is generated by an electrical device if one of said sensors senses an absence of pressure thereagainst. The signal is preferably an audible signal, having different characteristics for each sensor. Typically the sensors are pressure sensitive, capacitive or proximity switches. The electronic and signaling components are housed in a pocket on the back of the glove.

14 Claims, 2 Drawing Sheets

ELECTRONIC GOLF GLOVE TRAINING DEVICE

This is a continuation of copending application Ser. No. 08/505,569 filed on Jul. 21, 1995, now U.S. Pat. No. 5,655.223.

BACKGROUND OF THE INVENTION

This invention relates in general to a golf glove, worn in the same manner as a conventional golf glove, that includes an electronic mechanism to produce audible signals when the golfer improperly relaxes his or her grip about a golf club during a golf swing.

In playing golf, it has long been known that a firm grip should be maintained about a golf club during the backswing, downswing and well into the follow through. Many golfers, however, have a tendency to release their grip about the golf club or change their grip at certain points during their golf swing prior to striking the ball. The act of relaxing, releasing and regripping the golf club during the swing is undesirable and can lead to several different problems or a combination of problems. Included among the problems is the tendency of the golf club to rotate slightly in the hands of the golfer during the swing as the grip is relaxed or released, causing the face of the golf club to assume an improper orientation in relation to the intended line of flight. The resulting misorientation can cause the golf club to impart an undesirable spin on the ball, causing a hook or slice instead of a straight flight. Also, the relaxation or release of the grip during the swing can lead to improper rhythm and timing. Separation of the golfer's hands during the swing can cause inconsistency in the length of the swing and a tendency to overswing, in particular during the backswing. These problems may occur individually or in combination, resulting in generally inconsistent and undesirable results.

One of the most common ways an inexperienced golfer will relax his or her grip on the golf club during a swing is to allow the little, ring and middle finger of the gloved lead hand (the left hand for a right-handed golfer) to open slightly during the swing, thus loosening the grip on the golf club in the areas where the grip portion of the golf club rests in the central portion of the palm (opposite the thumb) of the gloved hand. Such relaxation or release of those three fingers generally causes the club head to drop at the top of the backswing, resulting in over-swing and causing the club to shift slightly in the golfer's grip. Such shifting ultimately causes the ball to be struck improperly and inconsistently.

Another common way an inexperienced golfer will relax his or her grip about the golf club during the swing is to allow the usually ungloved trailing hand (the right hand for a right-handed golfer) to become separated from the gloved hand during the back swing. This occurs where the palm and the base of the thumb of the usually ungloved hand rests on the back of the base of the thumb of the gloved lead hand. Such separation of the hands is generally caused by improper positioning of the trailing arm at the top of the swing (known as "flying elbow") and during the down swing. Shifting of the club in the hands of golfer, ultimately causes the ball to be struck improperly and inconsistently.

Most golfers use one of three different grip styles; namely, the single interlock, the double interlock and the single overlap. The problem of improperly maintaining a firm grip on the golf club is common to all grip styles. Thus, there is a need for a simple and effective way of training a golfer to maintain his or her grip about the club throughout the swing.

This training is complicated by the difficulty most golfers have in focussing their attention on their grip during the swing. Thus, most golfers are unable to control their grip about the golf club during the golf swing and do not realize that they may be relaxing, releasing or regripping the club during their swing. The result is inconsistent golf play and a general inability to correct the problem.

A number of different devices have been developed in an attempt to lock a golfer's hands together in the proper golf grip during the golf swing. Osborn, in U.S. Pat. No. 3,508,280 shows a pair of golf gloves which lock together with a tape fastener material. Skouron in U.S. Pat. No. 3,559,212 discloses a single glove with an attachment that holds the last three fingers of the lead hand in place. Odom, in U.S. Pat. No. 4,665,565 shows a pair of golf gloves which lock together with a hook-and-lock type fastener of the sort sold under the "Velcro" trademark. Freyer in U.S. Pat. No. 5,028,050 and Suttle in U.S. Pat. No. 5,184,827 both teach a pair of golf gloves which lock together with hook-and-loop material which produces a tearing sound when separated. Multiple attachments that secure the last two fingers of the gloved lead hand in place are described by Myers in U.S. Pat. No. 5,033,120. While each of these patents attempts to forcibly overcome the grip release or relaxation problem by preventing, at least up to a point, such relaxation or release, none actually teaches the golfer to use his or her natural ability to overcome the problem by maintaining a proper grip throughout the golf swing.

Murry, in U.S. Pat. No. 4,488,726 describes a glove for use in any sport in which a handle is gripped. Pressure sensitive normally closed switches are provided on the inside of each fingertip and the edge of the palm. When the grip on a handle is insufficiently tight at any one of these points an alarm sounds. This glove is not useful in detecting a release, relaxation or grip change of the ungloved trailing hand which should be continuously pressed against the gloved lead hand. Further, this arrangement cannot distinguish failure to maintain a firm grip by different portions of the hands.

The prior art devices that attempt to lock the golfer's hands together or around the golf club are cumbersome and generally uncomfortable. The straps and attachments must be removed and reattached, often requiring assistance by another person, when ever clubs are changed during play. These arrangements do not adapt well to the different types of grips different golfers may use. The straps and other parts may stretch and wear over time, making consistent application difficult. Finally, these devices which lock the golfer's hands in one particular orientation often do not actually teach the golfer a proper grip for later use without the device; rather, the golfer may become dependent on them in practice and be less able to form a proper grip when using a conventional glove during play.

Thus, there is a continuing need for improved methods and means for detecting release, relaxation or regripping during different parts of a golf swing and for teaching a golfer to maintain a proper grip throughout a golf swing and which are comfortable and convenient to use.

SUMMARY OF THE INVENTION

The above-noted problems, and others, are overcome in accordance with this invention by a golf glove for training a golfer, through his own ability and effort, to properly maintain his or her grip about a golf club throughout a golf swing, which emits one or more audible signals at critical points in the golf swing to indicate that the golfer's grip on the golf club is not proper at those points. Basically, the invention comprises a glove having a hand access opening and conventional finger stalls, configured to fit a golfer's lead hand (for a right-handed golfer, the left hand), at least one pressure-responsive sensor located in a region corresponding the palm area and the intersection of a golfer's palm and middle, ring and little fingers and/or in a region corresponding to the back of a golfer's thumb, short of the first or tip joint and electrical means for emitting an audible signal if pressure on a sensor is released.

Where two sensors are provided, one at each of the mentioned locations, a different audible signal will be generated by pressure release on each sensor. Any suitable pressure-responsive, normally open, electrical switch may be used. Preferably, the switches are selected from the group consisting of mechanical pressure-sensitive ("touch") switches, proximity switches and capacitance switches. For best results, a mechanical pressure sensitive switch is used for the sensor located on the palm as specified above since that switch is closed by a combined gripping and folding action as the grip is taken. An audible signal is generated when the switch is open.

In a particularly preferred embodiment, the switch is in the form of a flexible plastic sheet having two adjacent electrical conductor areas. Small areas, such as dots, of an electrically insulating material, typically a plastic, are spaced across one conductor. The sheet is folded to bring the two conductors into a face-to-face relationship. With no pressure on the conductor assembly, the switch will be open since the insulation areas will keep the conductors slightly spaced apart. When pressure is applied, contact will be made, and the audible signal will not be enabled.

The electronic and sound generating components are preferably enclosed in a pocket on the back of the glove. In optimum embodiments, these components are enclosed in a pocket on the outside of a flap closure for the glove.

In a preferred embodiment, the electrical means that produces the audible signal will sense when the golfer (after taking a hitting stance) and grips the golf club with both hands, closing the sensor switch or switches. After a predetermined time period, (such as 3 seconds) a distinctive audible signal, typically a beep or sequence of beeps will be sounded, indicating that the golfer may begin the backswing and that the electronic circuit has been activated. This will encourage the golfer to pause and relax before swinging and not step to the ball and immediately swing. If the golfer does not hear this signal, he or she has not taken a proper grip, and must readjust the grip until the signal is heard.

An interlock may be provided, typically in the form of a tilt switch in the electronic system, so that the grip relaxation signal cannot be emitted until the club has passed horizontal during the backswing. This will eliminate signals while the golfer is adjusting his or her stance and alternately gripping and relaxing the grip on the golf club. After a predetermined time period during which none of the glove sensors are activated, (typically, after a swing and during the period that the golfer walks to the ball location), such as 30 or 60 seconds, the circuit will enter a "sleep" mode to conserve energy until again activated by the golfer gripping a club.

The glove of this invention does not rely on extra attachments or locking mechanisms to force a golfer's grip to be maintained in any particular style or position. The glove may be used in practice or non-tournament play just as any conventional glove. This glove accommodates any type and individual style of golf grip and is simple and easy to use. Because the glove of this invention does not rely on locking devices or extra attachments, the golfer cannot become dependent on the device to maintain a correct grip and must learn to properly maintain his or her grip through his or her own efforts and abilities to avoid triggering the audible signals.

BRIEF DESCRIPTION OF THE DRAWING

Details of the invention, and of preferred embodiments thereof, will be further understood upon reference to the drawing, wherein.

DETAILED DESCRIPTION OF PREFERRED EMBODIMENTS

Figure 1:
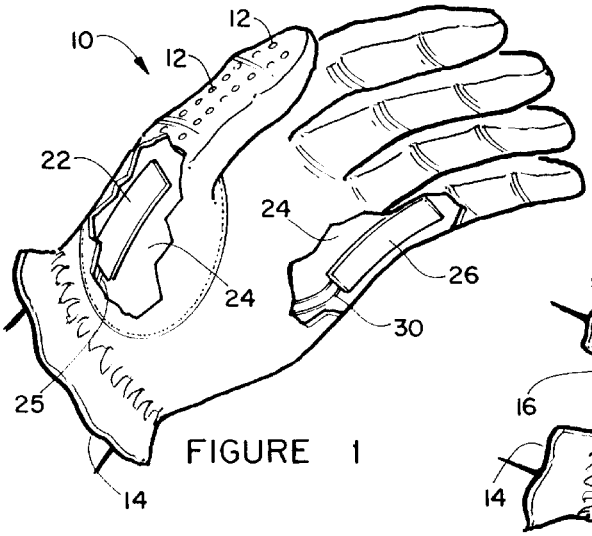
FIG. 1 is a front perspective view of the golf training glove of this invention.
Figure 2:
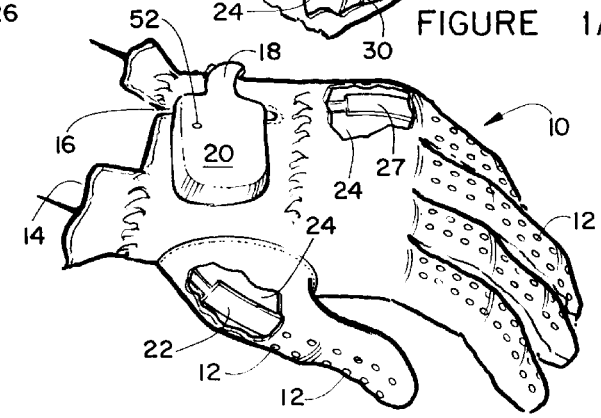
FIG. 2 is a back perspective view of the glove.

As seen in front and rear perspective views in FIGS. 1 and 2, the basic glove 10 is essentially a standard golf glove. The glove is made from cloth and/or supple thin natural or synthetic leather, typically two layers of material. The glove includes a plurality of ventilation holes 12, an access opening 14 into which the hand is slipped and a slit 16 extending along the glove from access opening 14 to permit the opening to be spread apart for ease of slipping over a hand.

A tab 18 (preferably an extension of pocket cover 20, described below) is fastened, such as by sewing, at one side of slit 16 and extends over the slit to the second side. Cooperating hook-and-loop material (not seen, shown on tab 18 in FIG. 5) is fastened in a conventional manner to tab 18 and the second side of slit 16, so that tab can be fastened at a point provide a snug, comfortable glove fit.

A first sensor 22, as seen in cut-away area 24, is mounted on the inner glove layer along an area corresponding generally to the back of a golfer's thumb, in an area short of the thumb joint closest to the tip of the thumb. Any suitable sensor 22 capable of turning an electrical circuit on or off may be used. Typical sensors include pressure-sensitive switches, proximity sensors and capacitance sensors. Wires 25 extend between the glove layers to electronic circuitry behind pocket cover 20. The size and shape of sensor 22 may be varied, so long as it is in an area of the thumb that is pressed by the trailing hand when a proper golf grip is taken.

Figure 1A:
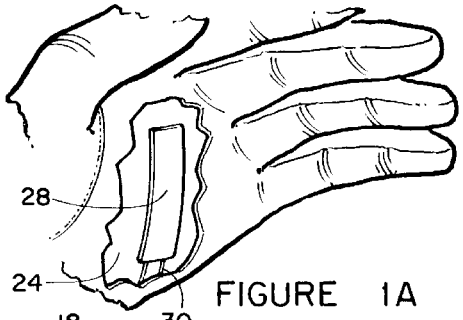
FIG. 1*a* is a front perspective view of the golf training glove of FIG. 1, showing an alternate location for sensor 28.

A second sensor is located between the glove layers in a region generally corresponding to a palm area and the intersection of a golfer's palm, middle, ring and little fingers. Sensor 26 can typically be located as seen in FIG. 1, (as revealed in cut-away area 24) basically at the intersection of the palm and little finger, or at the position shown in FIG. 1*a*, covering an area within that region basically between the palm and the intersection with the middle and ring fingers, or any position between those. Sensor 26 could be larger and cover the entire area around those shown at 26 and 28 in FIG. 1 and 1*a* respectively.

Figure 4:
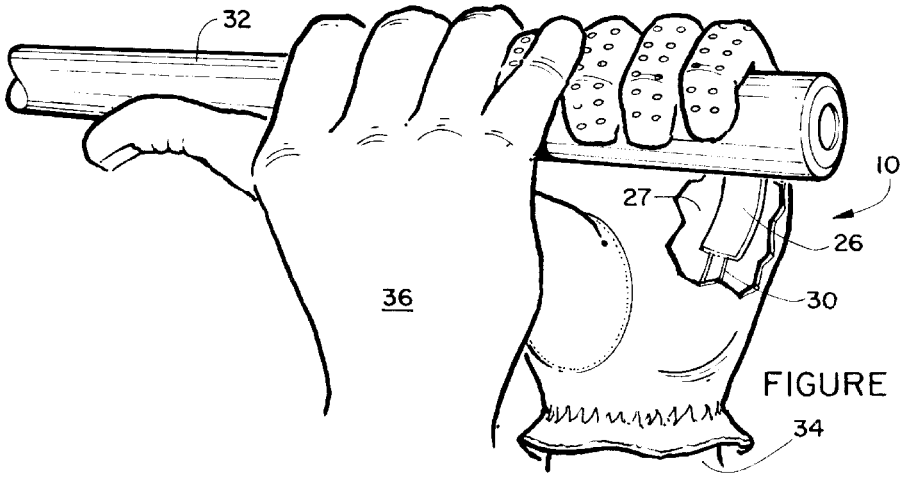
FIG. 4 is a front perspective view of the glove in use in gripping a golf club.

As seen in FIG. 2 sensor 27 is provided in a region corresponding to the intersection of the back of the hand and little finger, with the sensor activated (normally open switch closed) when the little finger is properly bent around the club 32 as seen in FIG. 4.

If desired, a glove may have only first sensor 22, or may only have second sensor 26, or, for optimum performance, may include both sensors 22 and 26.

Wires 30 extend from sensor 26 between the glove layers (or over the glove interior or exterior surface, if desired) to electrical components behind pocket cover 20, as detailed below.

Figure 3:
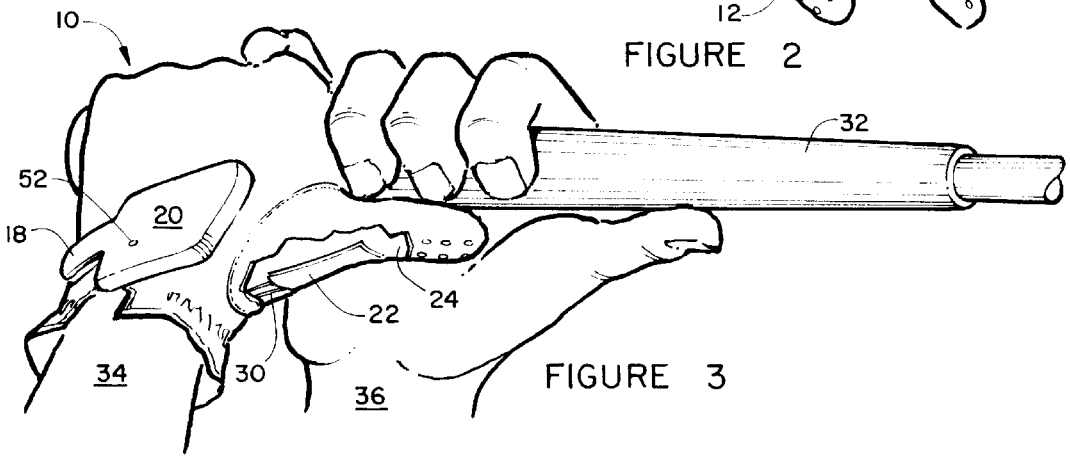
FIG. 3 is a back perspective view of the glove in use in gripping a golf club.

FIG. 3 shows glove 10 in use in gripping a golf club 32, with the grip loosened, typically at the top of the backswing. Lead hand 34 (left hand for a right handed golfer) is wearing glove 10. Trailing hand 36 is in engagement with club 32 and overlaps lead hand 34 in the conventional overlapping grip. As seen, the trailing hand grip has loosened, as often happens when the right elbow is raised during the backswing (so-called "flying elbow") pulling the right (trailing) hand away from the club. This releases contact in sensor 22, seen in cut-away area 24, causing the electronic circuit to activate a preselected audible signal, such as four pairs of beeps. The golfer thus be reminded that he or she should make an effort to keep the right elbow in the correct position during subsequent swings. When the elbow is correctly positioned, the position of the grip over the thumb of lead hand 34 will be correct (tight) and no signal will sound.

FIG. 4 shows a back perspective view glove 10 in use in gripping a golf club 32, with the grip loosened, typically at the top of the backswing. When the golfer brings the club back too far on the backswing the result is overswing so that the grip of lead hand 34 is loosened, releasing or relaxing the pressure between the palm of the lead hand and second sensor 26 around golf club 32. The electronic circuit will then cause a preselected audible signal to be generated, such as four beeps.

If only one of the two sensors 22 and 26 is used in a training glove 10, only the one audible signal will be generated if the corresponding area of the grip is relaxed or released. If both sensors are used, the golfer will hear one one signal or a "warbling" combination sound, indicating one or both of the swing errors has occurred. If the golfer hears no signal, then the grip was correct throughout the swing.

Figure 5:
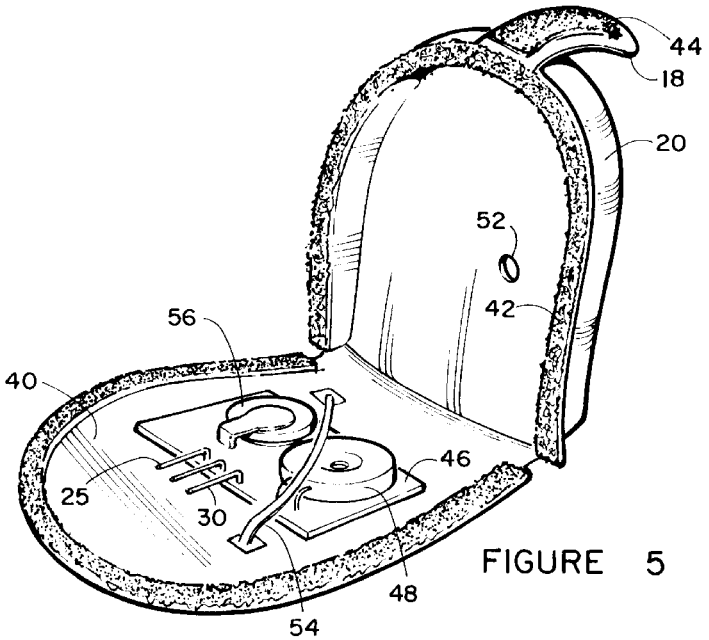
FIG. 5 is a perspective view of an open pocket for receiving electronic components.

A preferred container for the electronic and sound generating components is shown in FIG. 5. Here, a pocket is formed between panel 40 and cover 20. Hook-and-loop material, of the sort available under the "Velcro" trademark, is secured around the mating edges of panel 40 and cover 20, to securely close the pocket in use but permit easy opening. As mentioned above, a tab 18 extends beyond pocket cover 20 and bears a layer of hook-and-loop material cooperating with corresponding material adjacent to slit 16 as seen in FIGS. 2 and 3.

Figure 6:
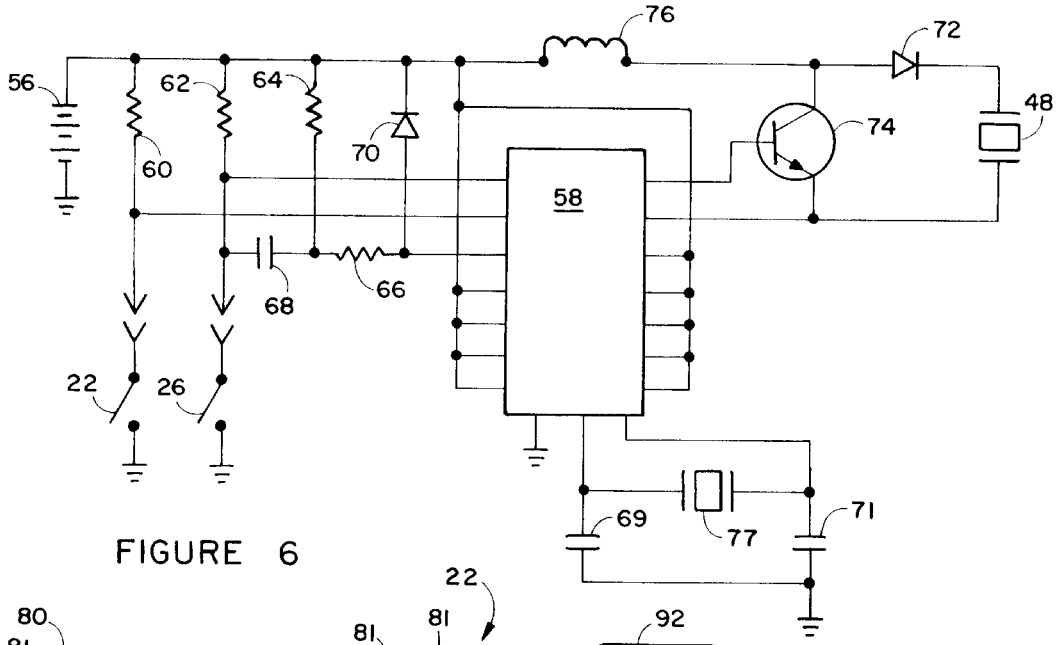
FIG. 6 is a circuit diagram of the electronic components.

A small circuit board 46 supports a sound generator 48, typically a piezo-electric horn such as a Model AT-150 from Projects Unlimited, Inc. and the electronic components 50 shown in the circuit diagram of FIG. 6. A elastic strap 54 extends across board 46 and is fastened to the glove on opposite sides thereof to hold the board at the pocket center. An opening 52 is preferably provided in pocket cover 20 to allow emission of sound waves from sound generator 48. Wires 25 and 30 extend from board 46 to sensors 22 and 26. Typically, where the sensors are in the form of printed circuit layers on a plastic substrate, conventional rivets can be used to connect flexible wires to the circuit strips.

A typical circuit for use in operating the sensor and alarm system is shown in FIG. 6. The circuit is powered by a small 3V battery 56, typically a BR1225-1HC battery from Panasonic. A microprocessor 58, typically a PIC16C54A from Microchip Technologies, programmed in a conventional manner, controls the system and sets the beep number and frequency and any other signals desired. Other components used include 39 KΩ resisters 60 and 62, 100 KΩ resistor 64, 3.3 KΩ resistor 66, 0.1 $\mu$F capacitor 68, 15PF capacitors 69 and 711N4148 diodes 70 and 72, 2N3904 transistor 74, 15.0 mHz inductor 76 and a 32 kHz surface mount crystal, such as a SE2405CT-ND from Digikey.

If desired, microprocessor 58 may be programmed in a conventional manner with other features. For example, when a golfer steps to the tee and grips a golf club, the initial gripping and pressing on sensors 22 and 26 can start a time sequence which generates a single beep after a selected time interval, such as 3 seconds. This will teach the golfer to assume his or her stance, then wait about 3 seconds before begining the backswing. This short delay will help the golfer relax, concentrate and avoid a hurried shot. Similarly, the pattern of beeps generated by each release of each sensor can be varied. If desired, some other warning signal can be used in place of the audible beeps. For example, a small vibrator in contact with the skin inside the glove could be caused to vibrate the skin when the swing is improper, or a mild electrical shock could be administered inside the glove. Also, the audible signal could be a synthetic voice signal generated by a conventional voiceprom.

Figure 7:
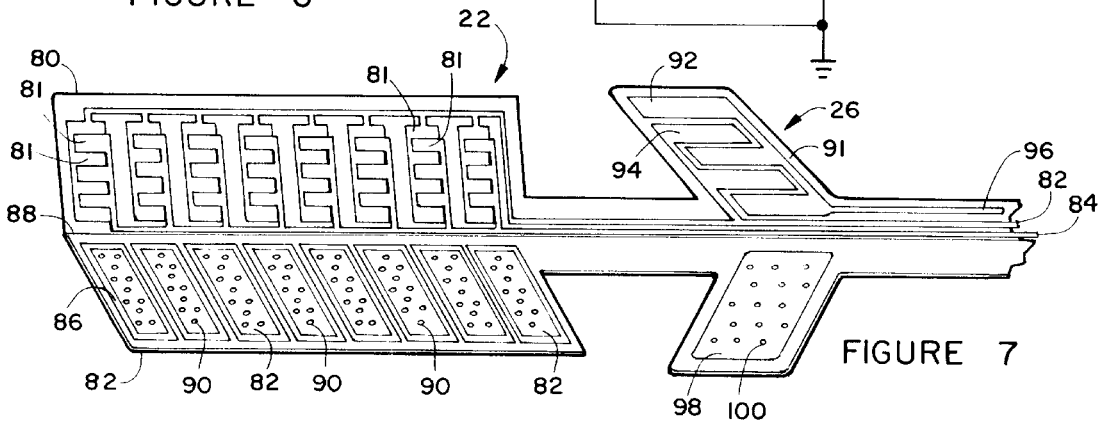
FIG. 7 is a perspective view of an embodiment of a grip switch assembly.

A preferred embodiment of a pressure-sensitive switch assembly is shown in FIG. 7. This assembly includes components making up first sensor 22 and second sensor 26. First sensor 22 includes a first panel bearing a series of patterns of spaced electrical conductors 81 on a thin, flexible electrically insulating plastic substrate. Current entering on a line 82 is isolated from outgoing line 84 by the small spacing between the two sets of conductor areas 81 in panel 80. Switch 22 is open until a conductive path is provided between those areas 81 connected to line 82 and those areas 81 connected to line 84.

A pattern of spaced conductive areas 86 is provided on an panel 82. When the substrate is folded along line 88 each area 86 overlays one set of conductive areas 81 on panel 80. A plurality of dots 90 of electrically insulating material are provided over conductive areas 86, preventing contact between the conductors in the two panels. However, when the panels are pressed tightly together, contact will be made extending past the inter-conductor areas on panel 80, closing the circuit.

Similarly, second sensor 26 includes one panel 91 having a number of spaced electrically conductive areas 92 and 94 connected to electrical conductor 96 and common conductor 82, respectively, and a second electrical conductor panel 98 having a 100 plurality of insulating dots. As before, when the assembly is folded along line 88, there will be no contact between conductive panel 98 and areas on panel 91 until compressive pressure is applied.

Where separate sensors 22 and 26 are used, as shown in FIGS. 1–4, each will typically have an individual shape similar to one of those areas shown in FIG. 7. For convenience of manufacture and assembly, a single assembly as shown in FIG. 7 is preferred. The spacing between sensors 22 and 26 will depend on the exact placement of the sensors desired. As shown, there are nine pairs of conductor areas in sensor 22, which will accommodate a large glove. If fewer such pairs of areas are desired, such as for use with a small glove, the endmost pairs can be simply cut off. Conductor lines 82, 84 and 96 may extend to the electronic components 46 or may be fastened to flexible wires by any suitable connectors, such as conventional rivet-like connectors adjacent to sensor 26.

While certain specific relationships, materials and other parameters have been detailed in the above description of preferred embodiments, those can be varied, where suitable, with similar results. Other applications, variations and ramifications of the present invention will occur to those skilled in the art upon reading the present disclosure. Those are intended to be included within the scope of this invention as defined in the appended claims.

I claim:

1. A golf training glove for emitting distinctive physically perceivable signals in response to a failure of a golfer to maintain a proper grip about a golf club during a golf swing, which comprises:

a glove having a hand access opening and a plurality of finger stalls, configured to fit a golfer's lead hand for gripping a golf club during a swing;

a first sensor means on said glove generally located in a region corresponding to the intersection of the back of a golfer's hand and little finger, for bending when a club is gripped;

activation signal means for generating a physically perceivable signal a predetermined time after a golfer initially correctly grips a golf club; and first electrical means on said glove connected to said first sensor for emitting a physically perceivable signal in the absence of said bending.

2. The golf training glove according to claim 1 wherein said first sensor comprises a normally open switch selected from the group consisting of mechanical pressure-sensitive switches, proximity switches and capacitance switches.

3. The golf training glove according to claim 1 wherein said sensor is a pressure sensitive switch comprising a plastic sheet carrying two adjacent electrical conductor patterns, at least one conductor pattern including a plurality of electrical insulating areas, said sheet being folded so that said conductor patterns are in a face-to-face relationship with said insulating areas separating said conductor patterns, whereby pressure on said sheet will cause said two conductor patterns to make contact.

4. The golf training glove according to claim 1 further including a pocket adjacent to said hand access opening along the back of the hand with hook and loop closure means, said pocket releasably receiving said electrical means.

5. The golf training glove according to claim 1 further including a second sensor means on said glove generally located in a region corresponding to the back of a golfer's thumb short of the endmost joint for pressing by the trailing hand when a club is gripped and said electrical means further includes means for emitting a distinctive audible signal if said second sensor senses an absence of pressure thereagainst.

6. The golf training glove according to claim 1 further including a third sensor means on said glove generally located in a region corresponding to a golfer's middle, ring and little fingers for pressing against a club when said club is gripped and said electrical means further includes means for emitting a distinctive audible signal if said third sensor senses an absence of pressure thereagainst.

7. A golf training glove for emitting distinctive audible signals in response to a failure of a golfer to maintain a proper grip about a golf club during a golf swing, which comprises:

a glove having a hand access opening and a plurality of finger stalls, configured to fit a golfer's lead hand for gripping a golf club during a swing;

a first sensor means on said glove generally located in a region corresponding to the intersection of the back of a golfer's hand and little finger, for bending when a club is gripped;

a second sensor means on said glove generally located in a region corresponding to the back of a golfer's thumb short of the endmost joint, for pressing by the trailing hand when a club is gripped;

electrical means on said glove connected to said sensors for emitting different distinctive audible signals if said first sensor detects a lack of bending and if said second sensor senses an absence of pressure thereagainst.

8. The golf training glove according to claim 7 wherein each of said sensors comprises a normally open switch selected from the group consisting of mechanical pressure-sensitive switches, proximity switches and capacitance switches.

9. The golf training glove according to claim 7 wherein at least one of said sensors is a pressure sensitive switch comprising a plastic sheet carrying two adjacent electrical conductor patterns, at least one conductor pattern including a plurality of electrical insulating areas, said sheet being folded so that said conductor patterns are in a face-to-face relationship with said insulating areas separating said conductor patterns, whereby pressure on said sheet will cause said two conductor patterns to make contact.

10. The golf training glove according to claim 7 further including a pocket adjacent to said hand access opening along the back of the hand with hook and loop closure means, said pocket releasably receiving said electrical means.

11. A golf training glove for emitting distinctive audible signals in response to a failure of a golfer to maintain a proper grip about a golf club during a golf swing, which comprises:

a glove having a hand access opening and a plurality of finger stalls, configured to fit a golfer's lead hand for gripping a golf club during a swing;

a first sensor means on said glove generally located in a region corresponding to the intersection of the back of a golfer's hand and little finger, for bending when a club is gripped;

a second sensor means on said glove generally located in a region corresponding to a golfer's palm area and the intersection of said golfer's palm and middle, ring and little fingers for pressing against a club when said club is gripped;

electrical means on said glove connected to said sensors for emitting different distinctive audible signals if said first sensor detects a lack of bending and if either of said first and second sensors senses an absence of pressure thereagainst.

12. The golf training glove according to claim 11 wherein each of said sensors comprises a normally open switch selected from the group consisting of mechanical pressure-sensitive switches, proximity switches and capacitance switches.

13. The golf training glove according to claim 11 wherein at least one of said sensors is a pressure sensitive switch comprising a plastic sheet carrying two adjacent electrical conductor patterns, at least one conductor pattern including a plurality of electrical insulating areas, said sheet being folded so that said conductor patterns are in a face-to-face relationship with said insulating areas separating said conductor patterns, whereby pressure on said sheet will cause said two conductor patterns to make contact.

14. The golf training glove according to claim 11 further including a pocket adjacent to said hand access opening along the back of the hand with hook and loop closure means, said pocket releasably receiving said electrical means.

* * * * *